US010384900B2

(12) United States Patent
Rodriguez et al.

(10) Patent No.: US 10,384,900 B2
(45) Date of Patent: Aug. 20, 2019

(54) DISPENSER APPARATUS AND METHOD OF USE FOR LAMINATING AND DISPENSING TRANSFER TAPE IN A PAPER WEB TURN-UP SYSTEM

(71) Applicants: Peter Rodriguez, Atlantic Beach, FL (US); Jason Rodriguez, Atlantic Beach, FL (US); Dennis A. Dohogne, St. Johns, FL (US)

(72) Inventors: Peter Rodriguez, Atlantic Beach, FL (US); Jason Rodriguez, Atlantic Beach, FL (US); Dennis A. Dohogne, St. Johns, FL (US)

(73) Assignee: SANDAR INDUSTRIES, INC., Atlantic Beach, FL (US)

( * ) Notice: Subject to any disclaimer, the term of this patent is extended or adjusted under 35 U.S.C. 154(b) by 60 days.

(21) Appl. No.: 15/899,849

(22) Filed: Feb. 20, 2018

(65) Prior Publication Data

US 2018/0339874 A1 Nov. 29, 2018

Related U.S. Application Data

(60) Provisional application No. 62/510,448, filed on May 24, 2017.

(51) Int. Cl.
*B65H 19/10* (2006.01)
*B65H 19/26* (2006.01)
(Continued)

(52) U.S. Cl.
CPC ..... *B65H 19/102* (2013.01); *B65H 16/021* (2013.01); *B65H 19/262* (2013.01);
(Continued)

(58) Field of Classification Search
USPC ..... 156/247, 249, 289, 537, 538, 555, 557, 156/580
See application file for complete search history.

(56) References Cited

U.S. PATENT DOCUMENTS 3,415,706 A 12/1968 Ettre
5,323,981 A * 6/1994 Dionne ..... B65H 19/102 156/502

(Continued)

FOREIGN PATENT DOCUMENTS

JP 2006206209 A * 8/2006

OTHER PUBLICATIONS

English Abstract of JP-2006206209-A (Year: 2019).*

*Primary Examiner* — Sing P Chan
(74) *Attorney, Agent, or Firm* — Thomas C. Saitta

(57) ABSTRACT

An apparatus and method for assembling, dispensing and using a laminated paper web transfer tape, an embodiment of the apparatus having a pair of transfer tape spools enclosed within a housing, one transfer tape spool containing a first tape component of the laminated transfer tape and the other transfer tape spool containing a second tape component of the laminated transfer tape, the first tape component being the combination of a substrate having adhesive on both sides and a release liner, the second tape component being a cover flap member having a release coating over at least a majority of one side. The components are unwound from the spools and pressed together such that they become joined along a longitudinal edge strip, then dispensed from the housing. The cover flap member covers one of the adhesive sides of the transfer tape substrate until the moment just prior to transfer of a continuous paper web from a full web spool to an empty web spool, the cover flap member being opened to expose the adhesive by air pressure or resistance.

24 Claims, 13 Drawing Sheets

(51) Int. Cl.
*B65H 19/28* (2006.01)
*B65H 16/02* (2006.01)
*B65H 35/00* (2006.01)

(52) U.S. Cl.
CPC ..... *B65H 19/267* (2013.01); *B65H 19/283* (2013.01); *B65H 19/286* (2013.01); *B65H 35/004* (2013.01); *B65H 2301/4128* (2013.01); *B65H 2301/41766* (2013.01); *B65H 2301/46312* (2013.01); *B65H 2402/41* (2013.01); *B65H 2801/84* (2013.01)

(56) References Cited

U.S. PATENT DOCUMENTS 5,417,383 A 5/1995 Rodriguez et al.
6,418,997 B1 * 7/2002 Tamai ..... B65H 37/007 118/257
6,452,748 B1 * 9/2002 Shima ..... G11B 23/043 360/132
6,500,259 B1 * 12/2002 Tamai ..... B65H 37/007 118/106
6,730,186 B2 * 5/2004 Takahashi ..... B44C 1/105 118/76
6,805,765 B1 * 10/2004 Brandli ..... B65H 19/102 156/159
6,808,581 B2 * 10/2004 Kuta ..... B65H 19/102 156/187
6,814,123 B2 * 11/2004 Erickson ..... B65H 19/102 156/450
6,830,089 B1 * 12/2004 Tamai ..... B65H 37/007 118/257
7,475,819 B2 * 1/2009 Moriyama ..... B41J 3/4075 235/375
7,540,445 B2 * 6/2009 Sogabe ..... G11B 23/044 242/346.2
7,866,561 B2 * 1/2011 Tanaka ..... B65C 11/0289 235/492
7,954,713 B2 * 6/2011 Nagae ..... G06K 1/121 235/375
7,992,791 B2 * 8/2011 Fukui ..... B41J 3/4075 235/487
7,994,917 B2 * 8/2011 Hirota ..... G06K 1/14 340/572.1
8,011,406 B2 * 9/2011 Niwa ..... B41J 3/4075 156/378
8,124,209 B2 2/2012 Rodriguez
8,152,392 B2 * 4/2012 Tanaka ..... G06K 19/07749 400/613
8,178,181 B2 5/2012 Rodriguez
8,330,602 B2 * 12/2012 Ohashi ..... G06K 19/07718 235/488
9,545,802 B2 * 1/2017 Sasaki ..... B41J 3/4075
2002/0189746 A1 * 12/2002 Kuta ..... B65H 19/102 156/157
2003/0062135 A1 * 4/2003 Takahashi ..... B44C 1/105 156/577
2003/0116256 A1 * 6/2003 Erickson ..... B65H 19/102 156/157
2007/0127968 A1 * 6/2007 Tanaka ..... G06K 17/0025 400/613
2007/0131769 A1 * 6/2007 Tanaka ..... B65C 11/0289 235/451
2007/0138281 A1 * 6/2007 Moriyama ..... B41J 3/4075 235/451
2007/0172290 A1 * 7/2007 Nagae ..... G06K 1/121 400/613
2007/0292858 A1 * 12/2007 Chen ..... B01L 3/502 435/6.18
2007/0295849 A1 * 12/2007 Sogabe ..... G11B 23/044 242/338.1
2008/0003043 A1 * 1/2008 Fukui ..... B31D 1/021 400/615.2
2008/0079585 A1 * 4/2008 Hirota ..... G06K 1/14 340/572.1
2008/0082914 A1 * 4/2008 Ueno ..... G06K 15/00 715/273
2008/0084274 A1 * 4/2008 Ohashi ..... G06K 19/07718 340/10.1
2008/0093027 A1 * 4/2008 Niwa ..... B41J 3/4075 156/387
2009/0295542 A1 * 12/2009 Hioki ..... B31D 1/021 340/10.1
2009/0319072 A1 * 12/2009 Fukui ..... B41J 3/4075 700/110
2010/0084095 A1 * 4/2010 Sekiya ..... B65H 37/007 156/378
2016/0271980 A1 * 9/2016 Sasaki ..... B41J 3/4075
2018/0339874 A1 * 11/2018 Rodriguez ..... B65H 19/102

* cited by examiner

DISPENSER APPARATUS AND METHOD OF USE FOR LAMINATING AND DISPENSING TRANSFER TAPE IN A PAPER WEB TURN-UP SYSTEM

This application claims the benefit of U.S. Provisional Patent Application Ser. No. 62/510,448, filed May 24, 2017.

BACKGROUND OF THE INVENTION

This invention relates generally in a first sense to the field of devices, apparatuses and methods of effecting the high-speed severing and transfer of a rapidly advancing paper web from a rotating full spool onto an empty spool, and more particularly where such an operation is performed utilizing a transfer or double-sided adhesive turn-up tape. More particularly, the invention relates to an apparatus and method for laminating, i.e., assembling, and dispensing transfer tape and its use in a paper web severing/transfer method, wherein the transfer tape is the effecting means for severing, transferring and securing the paper web from a rotating full spool onto an empty spool. Additionally, the invention relates in general to a tape dispenser apparatus that creates and dispenses a multi-layer tape by combining and laminating at least two component tapes useful in various industrial applications.

Modern paper manufacturing is typically performed by producing continuous lengths of paper having widths of over 400 inches in some cases, referred to as paper webs, which are wound onto spools to form rolls for subsequent converting, storage, transfer or the like. The winding or spooling operation for the paper web, such as in the case of tissue grades, occurs at high speeds, in some cases exceeding 6000 feet per minute. In order to maximize production by minimizing downtime and waste it is desirable to sever and simultaneously transfer the moving paper web from a full spool onto an empty spool without stopping or slowing the movement of the web, or without adjusting draws (i.e. the speed differential between the incoming and outgoing web rotating support members that are not driven by a common source). Methods and apparatuses for accomplishing this severing and transfer utilizing what is known as a transfer or turn-up tape have long been known. An early example of such a system is shown in U.S. Pat. No. 2,461,246 to Weyenberg, issued in 1949. Other examples are shown in my U.S. Pat. Nos. 4,659,029, 4,757,950, 4,783,018, 5,046,675, 5,453,141, 5,637,170, and 5,954,290. Further examples and detailed discussion of such equipment, systems and methodologies are presented in our U.S. Pat. Nos. 4,659,029, 4,757,950, 4,783,018, 5,046,675, 5,417,383, 5,453,141, 5,637,170, 5,954,290, 6,467,719, 6,578,788, 7,875,152, 8,124,209, 8,178,181 and 8,580,062, the disclosures of which are incorporated herein by reference.

The transfer tape utilized in severing and transferring the paper web comprises a substrate having a first adhesive side and a second adhesive side. The first adhesive side defines the spool attachment or mounting side, and is preferably comprised of a pressure sensitive adhesive (PSA), adapted to contact and adhere to the longitudinal cylindrical surface of the empty spool that receives the transferred paper web. The opposite side of the transfer tape substrate, the web grabbing side, has a second adhesive side adapted to contact and adhere to the moving paper web when the rotating spool is brought into contact with the paper web. With the adhesion of the paper web to the empty spool through this transfer tape, the web is severed from the full spool and its new leading edge, formed at the severing line caused by the transfer tape, adheres to the rotating empty spool, thus completing the transfer.

This invention is of particular application to transfer tapes of the type having a cover flap member extending over the web-side adhesive on the substrate of the transfer tape, the cover flap member being longitudinally adhered along one edge of the transfer tape, wherein the cover flap member is provided with a release coating, such as a silicone layer, over the majority of the side of the cover flap member facing the web-side adhesive. With this construction, the cover flap member remains closed after the transfer tape is mounted onto the empty spool to protect the web-side adhesive from contaminants such as dust and debris until the empty spool is spun up to its speed to match the speed of the web. As the empty spool rotates the release-coated portion of the cover flap member peels back or unfolds from the web-side adhesive due to aerodynamic affects, thereby opening the cover flap member. The cover flap member opens at its leading edge, which is the edge of the transfer tape first encountering the resulting airstream due to the rotation of the spool. The cover flap member remains attached to the web-side adhesive along the trailing edge of the transfer tape, which may be accomplished by zone coating the flap so as to be void of the silicone release layer along the narrow longitudinal trailing edge of the transfer tape substrate, or by folding over one edge of the cover flap member and adhering this folded portion to the web-side adhesive of the substrate. The transfer tape is now in a state with its protective cover flap member peeled back to expose the fresh and uncontaminated adhesive and is able to adhere to the subject paper web to sever and transfer it to the empty spool. Examples of such transfer tapes are shown and discussed in our U.S. Pat. Nos. 8,124,209 and 8,178,181.

The high-speed transfer of lightweight paper webs, such as groundwood papers (including, for example, newsprint) or tissue paper, is more difficult to accomplish due to the weaker structure of the paper. In addition, in systems using adhesive transfer tapes, the exposed adhesive side of the transfer tape is often contaminated with airborne dust, floating paper fibers and other debris, such that the adhesion is weakened or even substantially blinded, which can result in a failed transfer. A failed transfer results in lost production, inconsistent winding of the product and inconsistent roll sizes, excessive waste, shorter service life of the fiber cores which are commonly used in tissue making machines, and unsafe operating conditions.

Multi-layer transfer tapes also suffer storage and shelf-life problems when produced and maintained in completed form as rolls or coils. Unless the transfer tapes are exceedingly thin, which reduces strength and other desirable properties, variations in thicknesses and properties of the individual layers comprising the tape often result in buckling or delamination when the tape is unrolled from a storage spool or core. In addition, certain configurations of transfer tape, such as for example a tape having thick substrate layer or longitudinal corrugations, cannot be wound without flattening the corrugations. Thicker transfer tape substrates are preferable as the thicker tape makes better contact with rotating spools having fiber cores, as the cores are not always concentric, possibly resulting in relatively large gaps when the empty core is brought into contact with the web. Voids and gaps may also be present in the fiber cores themselves, and thicker substrates are better at filling the gaps to maximize contact of the adhesive to the moving web.

Furthermore, rolls of pre-manufactured transfer tapes may over time develop adhesion problems whereby the cover flap members may not readily release from the PSA adhesive. This can be a result of extended contact time between the cover flap member release coating and the web-side adhesive when the time between manufacture and use is significant, and/or increased adhesion resulting from tight winding of the transfer tape onto the storage spool. Storage times as little as a few days may result in ineffective transfer tapes. Any of these factors may result in undesirable adhesion between the release-coated portion of the cover flap member and the web-side adhesive layer of the transfer tape substrate.

It is an object of this invention to provide an apparatus and method addressing the contamination problem of the exposed adhesive on the transfer tape. It is a further object to provide such an apparatus and method that addresses the problems of excessive adhesion of the cover flap member by providing a transfer tape construction and a method of laminating the transfer tape into its final and complete form upon demand at the time the transfer tape is needed to avoid the aging problem. It is also an object to provide such and apparatus and method that produces transfer tape in short non-coiled, i.e., flat, segments to avoid the buckling or delamination problems. It is a further object to provide such an apparatus and method that allows for the use of transfer tape component storage spools capable of handling much greater lengths of transfer tape prior to exhaustion. It is a further object to provide such an apparatus and method that allows for the transfer tape to be laminated and dispensed in the desired length as needed for performing the turn-up operation. It is a further object to provide such an apparatus and method that allows for a greater range of transfer tape components for achieving optimal conditions for performing the turn-up operation. It is a further object to provide an apparatus and method adapted for use in many different industrial applications.

SUMMARY OF THE INVENTION

Figure 1:
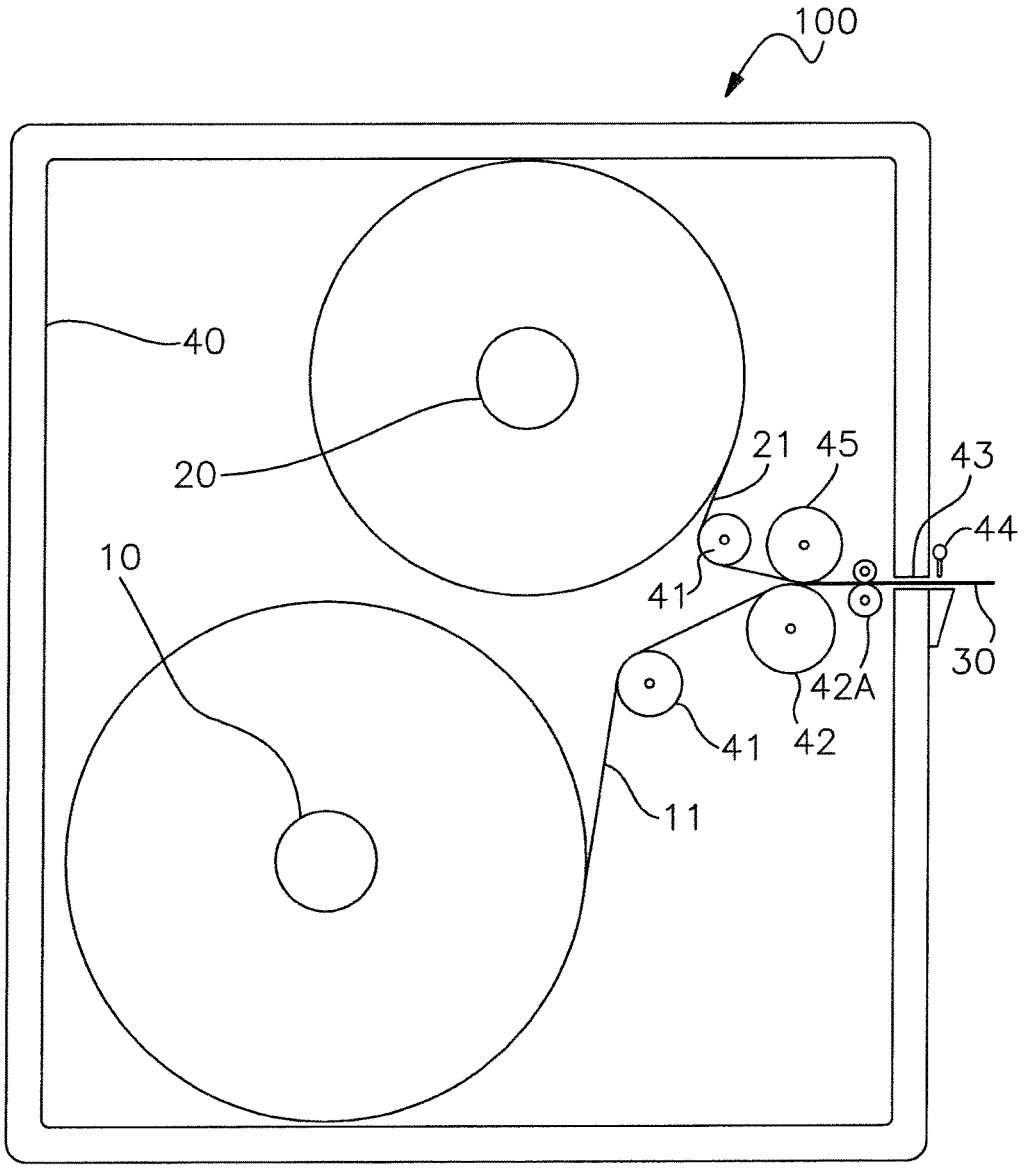
FIG. 1 illustrates an embodiment of the apparatus for laminating and dispensing transfer tape.

The apparatus comprises a dispenser apparatus for laminating, i.e., assembling from separate components, and dispensing a multi-layer tape, and in particular wherein the multi-layer tape is a paper web transfer tape, the apparatus comprising a pair of transfer tape spools, one transfer tape spool containing a first tape component of the laminated transfer tape and the other transfer tape spool containing a second tape component of the laminated transfer tape. The first tape component is a laminated composite of a release liner and a transfer tape base or substrate, the transfer tape substrate having a pressure sensitive adhesive (PSA) present on both sides. The release liner separates the adjoining PSA layers when the tape substrate is wound onto a first transfer tape spool, and then temporarily remains adhered to the PSA on the mounting side of the transfer tape substrate when the first tape component is removed from the first transfer tape spool, the release liner to be later removed to expose the mounting-side PSA adhesive when the transfer tape is later applied to a paper web spool to perform the turn-up operation. The second tape component is a composite of a cover flap member having a release coating on one side, the side which faces the web-side adhesive of the first tape component when the first and second components have been combined to form the transfer tape. The release coating is typically coated on or infused into the surface of the cover flap member material. The second tape component is provided on a second transfer tape spool distinct from the first transfer tape spool.

In one embodiment of the second tape component of the transfer tape the release coating on the cover flap member is a zone coating which covers the majority of the cover flap member surface but leaves a longitudinally extending strip along one edge of the cover flap member uncoated. The flap-covered transfer tape is produced by feeding the two tape components from the first and second transfer tape spools into a pressing mechanism such that the cover flap member adheres to the transfer tape substrate along the longitudinal edge that is void of release coating, with the release coated portion of the cover flap member extending across and facing the web-side PSA of the transfer tape substrate, thereby preventing strong adhesion of the majority of the cover flap member to the transfer tape substrate. With this construction, the cover flap member is effectively hinged to the transfer tape substrate of the first tape component along one edge.

In another embodiment for the second tape component of the transfer tape, the second tape component is a composite of a cover flap member having a release coating fully covering one side. The width of the cover flap member is greater than the width of the transfer tape substrate. To assemble the transfer tape components, one longitudinal edge of the cover flap member is folded such that a portion of the release coating abuts itself. When the tape components are fed through the roller press, the folded portion, which has no release coating on its exposed side, adheres to the web-side adhesive of the transfer tape substrate along one longitudinal edge. As with the first embodiment, the release coated side of the cover flap member extends across and faces the web-side PSA of the transfer tape substrate to prevent strong adhesion of the majority of the cover flap member to the web-side adhesive of the transfer tape substrate. As in the first embodiment, the cover flap member is now attached to the substrate in a longitudinally hinged manner.

Preferably, the dispenser apparatus comprises a housing or enclosure which prevents dust and other particulates from contacting the components, especially the exposed PSA surfaces, while the first and second tape components are on their respective transfer tape spools and during the laminating operation, the laminated transfer tape being dispensed from the enclosure through a small slot. Most importantly, by dividing and storing the transfer tape within the dispenser housing as a first tape component on a first transfer tape spool and as a second tape component on a second transfer tape spool, a significantly greater length of transfer tape can be laminated and dispensed from a single dispenser apparatus. Storing the thinner second tape component on one transfer tape spool and storing the thicker first tape component on the other transfer tape spool alleviates buckling, delamination, excessive adhesion and other problems encountered when trying to store a laminated transfer tape on a single transfer tape spool. Thus, the size of the component transfer tape spools can be minimized, such that they occupy less space within the protective enclosure, and such that a greater length of transfer tape can be produced before the transfer tape spools are exhausted. The apparatus allows for the on-demand production of short segments of flat laminated transfer tape in optimal condition in the required length as needed for the web turn-up transfer operation. Multiple embodiments of the dispenser and methodologies for forming and dispensing the transfer tape are discussed and illustrated herein.

In alternative manner, the invention is summarized and described as a transfer tape cartridge dispenser comprising: a housing retaining a first transfer tape spool, a second transfer tape spool and a press apparatus; said first transfer tape spool containing a first tape component, said first tape component comprising a transfer tape substrate having a width, a mounting-side adhesive disposed on one side of said transfer tape substrate, a web-side adhesive disposed on the opposite side of said transfer tape substrate, and a release liner disposed on said mounting-side adhesive; said second transfer tape spool containing a second tape component, said second tape component comprising a cover flap member having a width, a longitudinal edge and a release coating disposed on said cover flap member, wherein said release coating is zone-coated onto said cover flap member such that a longitudinally-extending uncoated joining strip is defined adjacent said longitudinal edge of said cover flap member; whereby said press apparatus is adapted to press together said first tape component and said second tape component, such that upon passing said first tape component and said second tape component through said press apparatus said web-side adhesive of said first tape component is joined to said uncoated joining strip of said second tape component to form a transfer tape, said transfer tape being adapted to sever and secure a paper web from a first web spool onto an empty web spool in a web turn-up operation in a manner whereby with said release liner removed from said mounting-side adhesive, said mounting-side adhesive being adapted to adhere said transfer tape to the empty web spool, and further whereby said cover flap is adapted to open to expose said web-side adhesive upon rotation of the empty web spool, said web-side adhesive being adapted to adhere to the paper web. In further embodiments, the invention wherein said mounting-side adhesive and said web-side adhesive are pressure sensitive adhesives; wherein said housing further comprises a slot, and wherein said transfer tape passes through said slot; further comprising one or more guide rollers adapted to guide said first tape component and said second tape component; further comprising a cutter apparatus adapted to sever said transfer tape; further comprising an embossing mechanism adapted to emboss said transfer tape; further comprising a wiper member adapted to apply pressure to said transfer tape during the application of said transfer tape to the empty paper web; wherein said press apparatus comprises a pair of rollers; wherein said cover flap member width is greater than said transfer tape substrate width, and wherein said uncoated joining strip is folded inwardly such that said web-side adhesive of said first tape component is joined to said folded uncoated joining strip when said first tape component and said second tape component are passed through said press apparatus; said housing further comprising a folding mechanism adapted to fold said cover flap member to create said folded uncoated joining strip; further comprising perforating mechanism adapted to longitudinally perforate said cover flap member to define said folded uncoated joining strip; and/or said housing further comprising a take-up spool adapted to accumulate said release liner removed from said transfer tape substrate.

Alternatively still, the invention is summarized and described as a method of producing a transfer tape, said transfer tape being adapted to sever and secure a paper web from a first web spool onto an empty web spool in a web turn-up operation, said method comprising the steps of: providing a first tape component wound onto a first transfer tape spool, said first tape component comprising a transfer tape substrate having a width, a mounting-side adhesive disposed on one side of said transfer tape substrate, a web-side adhesive disposed on the opposite side of said transfer tape substrate, and a release liner disposed on said mounting-side adhesive; providing a second tape component wound onto a second transfer tape spool, said second tape component comprising a cover flap member having a width, a longitudinal edge and a release coating disposed on said cover flap member, wherein said release coating is zone-coated onto said cover flap member such that a longitudinally-extending uncoated joining strip is defined adjacent said longitudinal edge of said cover flap member; joining said first tape component to said second tape component to form a transfer tape by pressing together said web-side adhesive of said first tape component to said uncoated joining strip of said second tape component; and severing said transfer tape to separate the transfer tape from the first and second taper components. Furthermore, the invention further comprising the step of removing said release liner from said mounting-side adhesive; further comprising the step of adhering said mounting-side adhesive of said transfer tape to an empty web spool with said cover flap oriented to open to expose said web-side adhesive upon rotation of the empty web spool; further comprising the step of adhering said web-side adhesive to a paper web; wherein said step of joining said first tape component to said second tape component to form said transfer tape and said step of severing said transfer tape is performed immediately prior to said step of removing said release liner from said mounting-side adhesive and said step of adhering said mounting-side adhesive of said transfer tape to the empty web spool; wherein said step of adhering said mounting-side adhesive of said transfer tape to the empty web spool is performed manually; and/or further comprising the step of enclosing said first tape component and said second tape component to preclude particulate contamination of said mounting-side adhesive and said web-side adhesive.

Further still, the invention is summarized and described as a paper web turn-up method comprising the steps of: producing a transfer tape adapted to sever and secure a paper web from a first web spool onto an empty web spool in a web turn-up operation, said step of producing said transfer tape comprising: providing a first tape component wound onto a first transfer tape spool, said first tape component comprising a transfer tape substrate having a width, a mounting-side adhesive disposed on one side of said transfer tape substrate, a web-side adhesive disposed on the opposite side of said transfer tape substrate, and a release liner disposed on said mounting-side adhesive; providing a second tape component wound onto a second transfer tape spool, said second tape component comprising a cover flap member having a width, a longitudinal edge and a release coating disposed on said cover flap member, wherein said release coating is zone-coated onto said cover flap member such that a longitudinally-extending uncoated joining strip is defined adjacent said longitudinal edge of said cover flap member; joining said first tape component to said second tape component to form a transfer tape by pressing together said web-side adhesive of said first tape component to said uncoated joining strip of said second tape component; and severing said transfer tape to separate the transfer tape from the first and second taper components; removing said release liner from said mounting-side adhesive; adhering said mounting-side adhesive of said transfer tape to the empty web spool with said cover flap oriented to open to expose said web-side adhesive upon rotation of the empty web spool; and adhering said web-side adhesive to the paper web by rotating the empty web spool to open said cover flap and bringing said web-side adhesive into contact with the paper web. Furthermore, the invention wherein said step of joining said first tape component to said second tape component to form said transfer tape and said step of severing said transfer tape is performed immediately prior to said step of removing said release liner from said mounting-side adhesive and said step of adhering said mounting-side adhesive of said transfer tape to the empty web spool; wherein said step of adhering said mounting-side adhesive of said transfer tape to the empty web spool is performed manually; further comprising the step of enclosing said first tape component and said second tape component to preclude particulate contamination of said mounting-side adhesive and said web-side adhesive; and/or wherein said step of adhering said mounting-side adhesive of said transfer tape to the empty web spool is performed manually.

DETAILED DESCRIPTION OF THE INVENTION

With reference to the drawings, which are provided for illustrative and descriptive purposes and which are not meant to be limiting as to the scope of the invention, the invention in general embodiments comprises an apparatus and a method for assembling, i.e., laminating, and dispensing a multi-layer adhesive tape, and in particular wherein the multi-layer adhesive tape is a transfer tape used in a paper web turn-up operation, wherein a continuous paper web being rolled onto a first spool is severed and transferred to an empty spool when the first spool is fully wound, the transfer occurring without requiring the flow of the paper web to be temporarily altered, slowed or stopped. Multiple embodiments of the apparatus and method which produce different transfer tapes are illustrated and described. It is to be understood that disclosure of the apparatus and method in relation to a paper web turn-up operation is an exemplary disclosure not meant to be limiting, as the dispenser structure as described is suitable for the production of different types of tapes for different industrial applications.

In a basic embodiment, the dispenser apparatus 100 comprises a first transfer tape spool 10 having a first tape component 11 of the laminated transfer tape 30 wound onto the spool 10 to form a roll, and a second transfer tape spool 20 having a second tape component 21 of the laminated transfer tape 30 wound onto the spool 20 to form a roll. Most preferably, the dispenser apparatus 100 is constructed such that the spools 10/20 are substantially enclosed or sealed by a housing or enclosure 40 such that that dust and particulates are prevented from entering the housing 40 to contaminate the tape components 11/21 of the transfer tape 30.

The first tape component 11 is a ribbon-like, laminated composite comprising a transfer tape base or substrate 12 and a release liner 13. The transfer tape substrate 12 is preferably composed of paper stock or similar suitable material, most preferably re-pulpable, of sufficient strength, thickness, texture and stiffness to accomplish the turn-up transfer operation without breaking or separating during use. Both sides of the substrate 12 are coated, infused, layered or laminated with an adhesive, preferably a pressure sensitive adhesive (PSA). One adhesive is a mounting-side adhesive or PSA 14, suitable for attaching one side of the transfer tape substrate 12 to an empty paper web spool 50. The other adhesive, which may be the same or different from the mounting-side PSA 14, is a web-side adhesive or PSA 15 suitable for attaching the other side of the substrate 12 to a paper web 60 of tissue or thicker paper material. The mounting-side PSA 14 may have different properties compared to the web-side PSA 15. These differing properties may include adhesion, tackiness, color, or thickness, among others.

Figure 2:
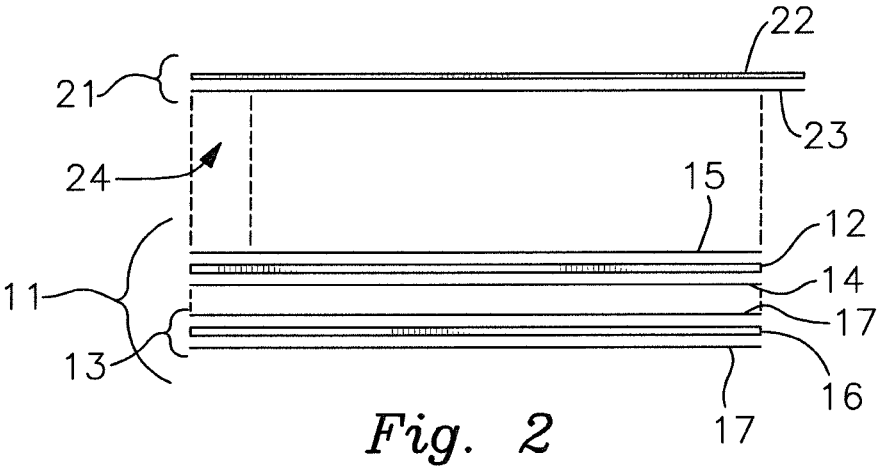
FIG. 2 is an exploded view showing the components of a transfer tape produced in the apparatus of FIG. 1.
Figure 4:
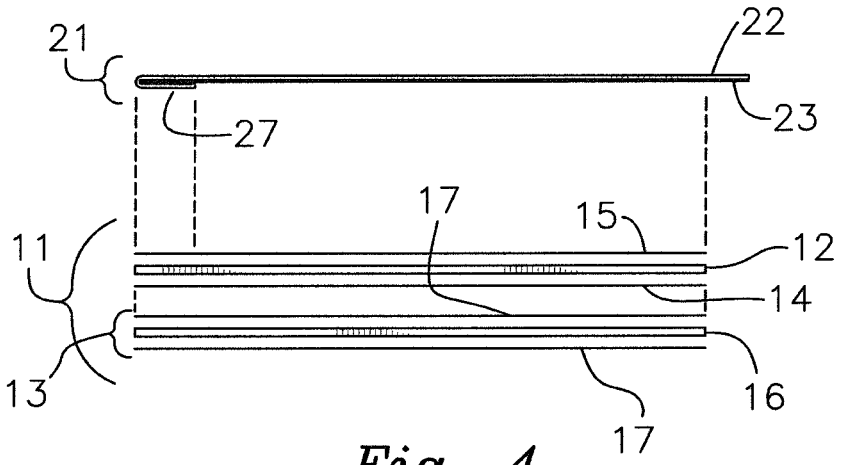
FIG. 4 is an exploded view showing the components of a transfer tape produced in the apparatus of FIG. 4.

The release liner 13 is a thin, sheet member that removably adheres to temporarily and covers the mounting-side PSA 14 of the substrate 12. The release liner 13 is removed prior to mounting the transfer tape 30 onto an empty web spool 50. In a representative embodiment as shown in FIGS. 2 and 4, the release liner 13 may be composed of a thin carrier member 16 having a release coating 17, such as a silicone or other material that has low adhesion to the PSA's 14/15, applied or layered on both sides of the carrier member 16. The release liner 13 may have differential release properties such that one side releases from the web-side PSA 15 more easily than the other side. Prior to being wound onto the first transfer tape spool 10, the release liner 13 is laminated or abutted to the mounting-side PSA 14, such that the web-side PSA 15 remains exposed. The release liner 13 will typically be coated such that the side in contact with the mounting-side PSA 14 has slightly higher adhesion than would the opposite (outer) side of the release liner 13. Thus, when the first tape component 11 is wound onto first transfer tape spool 10, the exposed web-side PSA 15 will be brought into contact with the opposite (outer) side of the release liner 13 having lower adhesion properties, such that when the first transfer tape 11 is unwound from the first transfer tape spool 10, the release liner 13 releases from the web-side PSA 15 and remains adhered to the mounting-side PSA 14.

Figure 5:
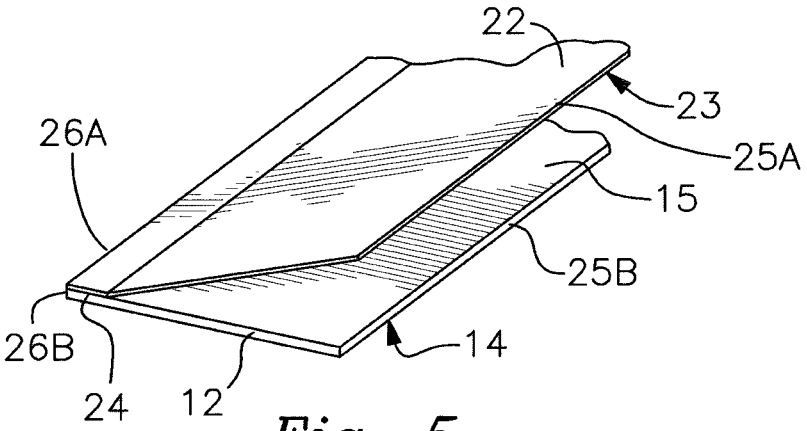
FIG. 5 is a partial view of the laminated transfer tape of FIG. 2, shown with the release liner removed.
Figure 6:
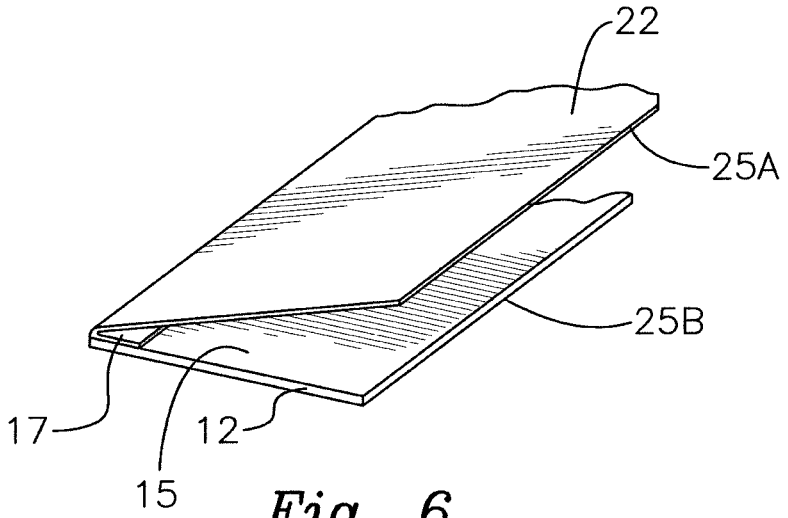
FIG. 6 is a partial view of the laminated transfer tape of FIG. 5, shown with the release liner removed.

The second tape component 21 comprises a thin, ribbon-like cover flap member 22, preferably composed of re-pulpable material, and a release coating 23. The release coating 23 is composed of a material, such as silicone, that has very low adhesion to the web-side PSA 15. When first and second tape components 11/21 are joined to form the completed transfer tape 30, the release coating 23 of the second tape component 21 is disposed adjacent to the web-side PSA 15 of the first tape component 11. One embodiment for the second tape component 21 is shown in FIGS. 2 and 5. While a majority of the surface of the cover flap member 22 brought into contact with the web-side PSA 15 of the first tape component 11 is coated with the release coating 23, a longitudinal joining strip 24 adjacent to one longitudinal edge of the cover flap member 22 is not coated. This uncoated joining strip 24 permanently adheres the cover flap member 22 to the corresponding region of the web-side PSA 15 on the tape substrate 12. This uncoated joining strip 24 may be achieved in this embodiment by zone coating the release coating material 23 onto the majority of one side of the cover flap member 22 while leaving the longitudinal joining strip 24 uncoated. Alternatively, the hinged attachment of the cover flap member 22 to the substrate 12 may be achieved by folding a narrow portion of a cover flap member 22, fully coated on one side along one longitudinal edge, to create the joining strip 24 and positioning this narrow uncoated folded portion of the cover flap member 22 on the web-side PSA 15 of the substrate 12 such that the folded uncoated portion of the cover flap member adheres to the web-side PSA 15 as shown in FIGS. 4 and 6. To account for the folded portion of the cover flap member 22, the width of the cover flap member 22 must be greater than the width of the substrate 12 in order to fully cover the exposed web-side PSA 15.

Figure 3:
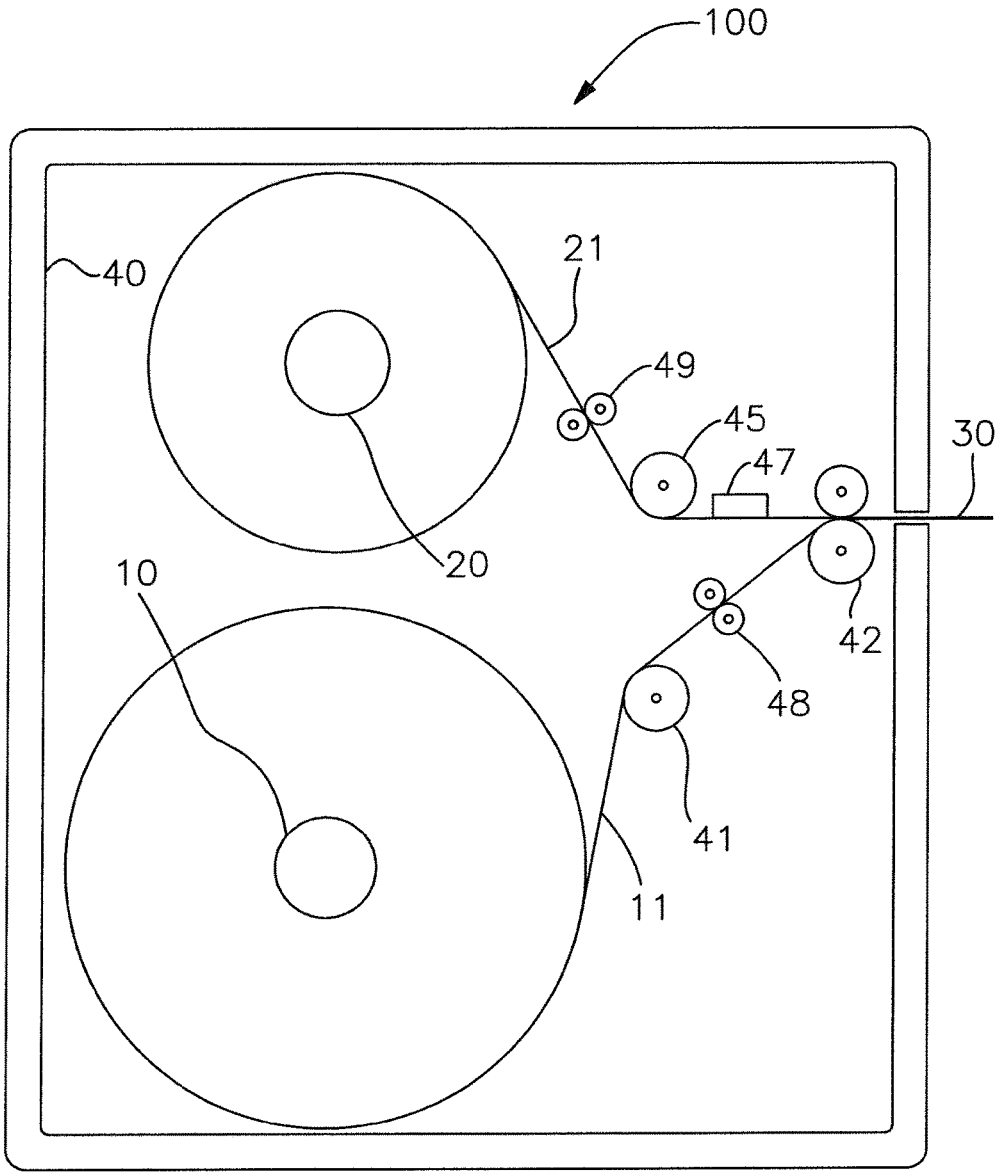
FIG. 3 illustrates an alternative embodiment of the apparatus for laminating and dispensing transfer tape.

In one embodiment of a methodology for assembly of the transfer tape 30, the first tape component 11 and second tape component 21 are each fed or pulled from the tape transfer spools 10/20 and passed over a guide roll 41 and fed into a roller or nip press apparatus 42, as shown in FIGS. 1 and 3. The first and second tape components 11/21 are passed through the press apparatus 42 in register such that the interior side of the cover flap member 22 is brought into contact with the web-side PSA 15 of the transfer tape substrate 12 under pressure. In this manner, the joining strip 24 contacts and adheres to the web-side PSA 15 of the tape substrate 12 along one longitudinal edge to form a hinge-like connection. The release coating 23 covering the majority of the interior side of the cover flap member 22 provides low adhesion for the majority of the cover flap member 22 contacting the exposed web-side PSA 15, and high adhesion between the cover flap member 22 and the web-side PSA 15 along the narrow longitudinal uncoated region of the joining strip area 24, as shown in FIGS. 5 and 6. A second press 42A having a width corresponding approximately to the width of the joining strip 24 may be utilized to apply greater pressure to the joining strip 24 for the purpose of achieving higher adhesion between the joining strip 24 and the transfer tape substrate 12, as shown in FIG. 1.

The laminated and covered transfer tape 30 is then dispensed through a slot 43 in the housing 40. The transfer tape 30 is moved through the dispenser apparatus 100 by any of several methods including manually pulling the tape 30 from the dispenser housing 40 or by the turning of a feed wheel 45 with a manual crank or a motor. The feed wheel 45 may be a separate component of the dispenser apparatus 100 or may also be comprised in the press apparatus 42. A cutter apparatus 44 positioned at or adjacent the exit of the housing 40 may be used to fully detach the desired length of transfer tape 30. The cutter apparatus 44 may completely sever the tape 30 or be structured to perforate and weaken the transfer tape 30 for manual separation by the operator. A wiper member 46 may also be disposed on the exterior of the housing 40 to apply pressure to the transfer tape 30 as it is drawn across and applied to the empty spool 50. The length of tape 30 to be dispensed may be determined visually by the operator or by the use of a resettable distance meter (not shown) that is appropriately linked to the dispensing apparatus 100.

The dispensed transfer tape 30 s then positioned on the empty web spool 50 with at least a portion of the release liner 13 removed. The mounting side PSA 14 of the transfer tape 30 is adhered to the longitudinal surface of the web spool 50 such that the web side PSA 15, covered by cover flap member 22, faces outward and away from the web spool 50. The transfer tape 30 is oriented on the web spool 50 such that the leading edge 25A of the cover flap member 22, which is the edge that will open, is facing into the airstream or air resistance that is created when the empty web spool 50 is rotated up to speed to match the line speed of the paper web 60. Conversely, the trailing edge 26A of the cover flap member and the trailing edge 26B of the substrate 12, which is the edge of the tape 30 where the cover flap member 22 is hinged and retained, is facing away from the airstream of the rotating web spool 50. Any remaining release liner 23 on the mounting side PSA 14 of the transfer tape substrate 12 is then removed and the complete length of tape 30 is applied to the surface of the web spool 50. The removed release liner 13, preferably comprised of re-pulpable materials, is typically then disposed of in the paper making equipment to be recycled into the paper product.

In an alternative version shown in FIGS. 3, 4 and 6, the first tape component 11 is the same as described above. The second tape component 21 is different however, in that the cover flap member 22 is wider than the cover flap member 22 described above and one side (the interior side) of the cover flap member 22 is fully covered by the flap release coating 23. The second tape component 21 is wound onto and dispensed from the second transfer tape spool 20 in a flat configuration. Prior to passing into the press apparatus 42, a longitudinal edge portion of the cover flap member 22 is folded back upon itself by a folding mechanism 47 located within the housing 40 to form the narrow joining strip 24 that adheres to the web-side PSA 15 of the tape substrate member 12 along the longitudinal trailing edge 26B to define the hinge structure, there being no release coating on that side of the cover flap member 22. As before, the release coating 23 on the interior side of the cover flap member 22 provides low adhesion over the majority of the cover flap member 22 to the remaining exposed web-side PSA 15, as shown in FIG. 6, and high adhesion along the uncoated joining strip area 24.

With the release liner 13 removed from the transfer tape 30, the transfer tape 30 is properly oriented and applied onto an empty web spool as previously described. As the empty web spool is rotated in order to grab, tear and transfer the continuous paper web 60, air pressure from the rotation or from dedicated air nozzles (not shown) opens the cover flap member 22 to expose the web-side PSA 15 of the transfer tape substrate 12. In alternate embodiments for the transfer tape 30, the cover flap member 22 may be sized such that the cover flap member leading edge 25A extends beyond the substrate leading edge 25B so as to open more easily when the web spool 50 is rotated. The rotating web spool 50 with its transfer tape cover flap member opened to expose the web-side PSA 15 is brought into contact with the moving paper web and the exposed web-side PSA 15 adheres to the paper web. As the empty spool 50 continues rotation and moves the transfer tape 30 out of the paper path of the full support spool it takes the newly adhered paper web with it, causing the paper web to tear and begin winding on the empty web spool 50, thus successfully completing the vital turn-up operation without requiring slowing or stopping the paper web flow.

Since the web-side PSA 15 is stored within an enclosed housing 40 and remains covered by the cover flap member 22 until the moment of use, there is less chance that any significant contamination can occur to lessen the adhesive strength of the web-side PSA 15, thereby insuring a successful web transfer.

In additional embodiments the first and second tape components 11/21 may have additional operations performed on them as they progress from their transfer tape spools 10/20 to be combined into the finished transfer tape 30. These additional embodiments can include an embossing mechanism 48 to add thickness or bulk to the transfer tape substrate 12. The embossing mechanism 48 may comprise, for example, one or more embossing rollers textured or fabricated with appropriate grooves to transition the substrate 12 from a mostly flat cross section to one that is appreciably thicker due to the presence of embossed indentations or corrugations. Typically, the embossing mechanism 48 will comprise another roller used in conjunction with the embossing roller, the additional roller having either a complimentary texture or being made from a compressible material to accommodate forcing the component into the recesses of the embossing roller.

In another embodiment the dispenser apparatus 100 comprises a perforating mechanism 49 that longitudinally perforates the cover flap member 22 as it is unspooled from its transfer tape spool 20 prior to its being folded longitudinally. The perforation of the cover flap member 22 facilitates a consistent and controlled folding of the edge for its subsequent strong adhesion to the web-side PSA 15 of the transfer tape substrate 12. This perforation can be readily accomplished for example by a roller having a ring of perforating teeth which make a linear series of interrupted piercings or slits in the cover flap member 22. More sophisticated methods could also be employed to accomplish this perforation, such as using a laser timed to make interrupted cuts through the cover flap member 22.

Figure 15:
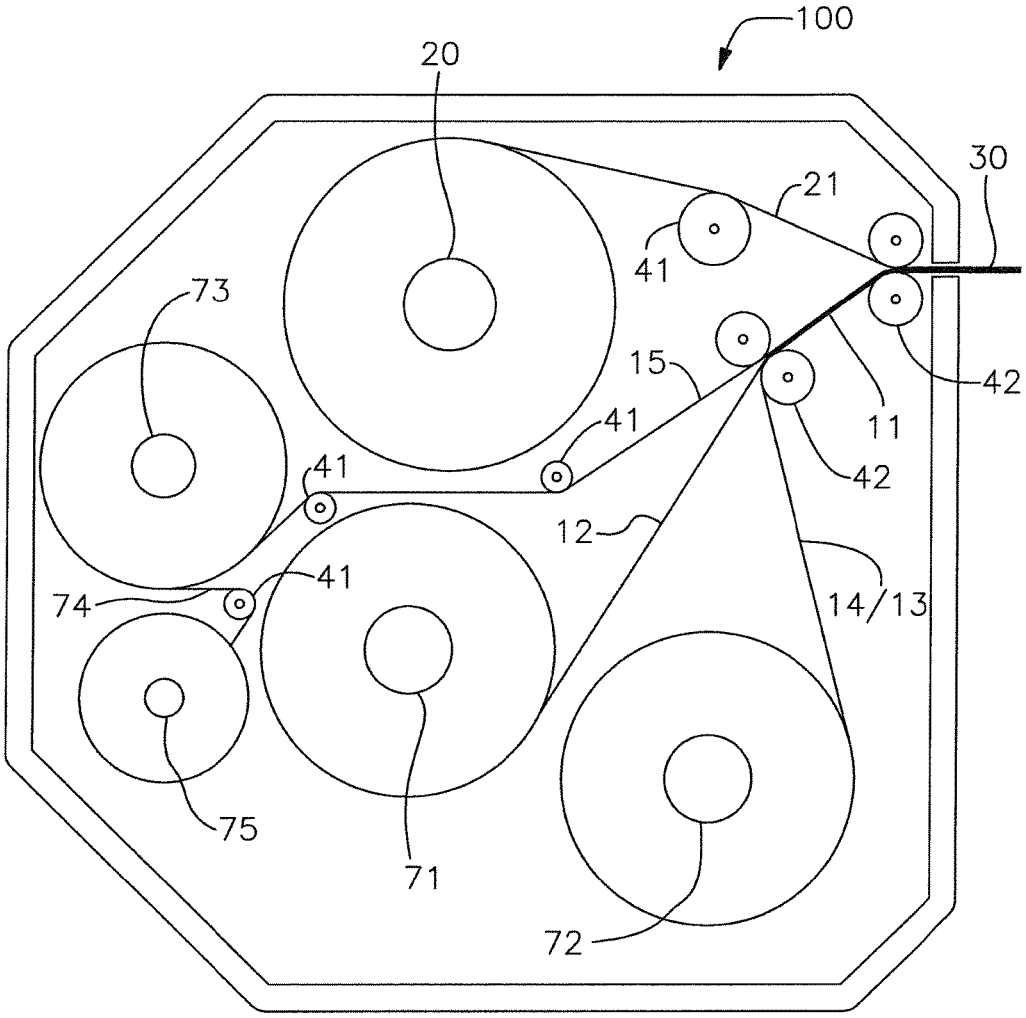
FIG. 15 is an illustration of an alternate embodiment for the dispenser wherein the first tape component is assembled within the dispenser.

In another embodiment, as shown in FIG. 15, the first tape component 11 may itself be formed by combining constituent components within the dispenser apparatus 100 prior to lamination with the second tape component 21. In this embodiment, the single transfer tape spool 10 for the first tape component 11 is replaced by a plurality of supply spools consisting of a) a supply spool 71 containing a roll of substrate 12, b) a supply spool 72 of mounting-side PSA 14 (with its own double-sided release liner that will become the mounting-side release liner 13 of the finished tape 30), and c) a supply spool 73 of web-side PSA 15 (with its own temporary release liner 74 to accommodate its winding upon its supply spool 73). The dispenser apparatus 100 is then configured to guide these constituents to be laminated together to form the first tape component 11. In this operation, the temporary release liner 74 is peeled off and wound onto a release liner take-up spool 75 prior to lamination of the web side PSA 15 to the second tape component 21. An advantage of this multi-component operation is that the constituent components can be kept even more fresh and clean, the web-side PSA 15 in particular since the temporary release liner 74 is constructed to protect the web-side PSA 15 while on its supply spool 73. Also, the substrate 12 can be made thicker than if it were to be pre-coated with PSA and wound in conjunction with the mounting-side release liner 13. This thicker substrate 12 can negate the need for embossing to strengthen the tape 30. However, with this configuration, embossing the substrate 12 can actually be more easily accomplished prior to it being laminated with the web-based PSA 15 and mounting-side PSA 14. The first and second tape components 11/21 can be supplied in a cartridge form such that the cartridge protects the components during storage and handling and has the components pre-positioned for easy threading into the dispenser apparatus 100.

Figure 7:
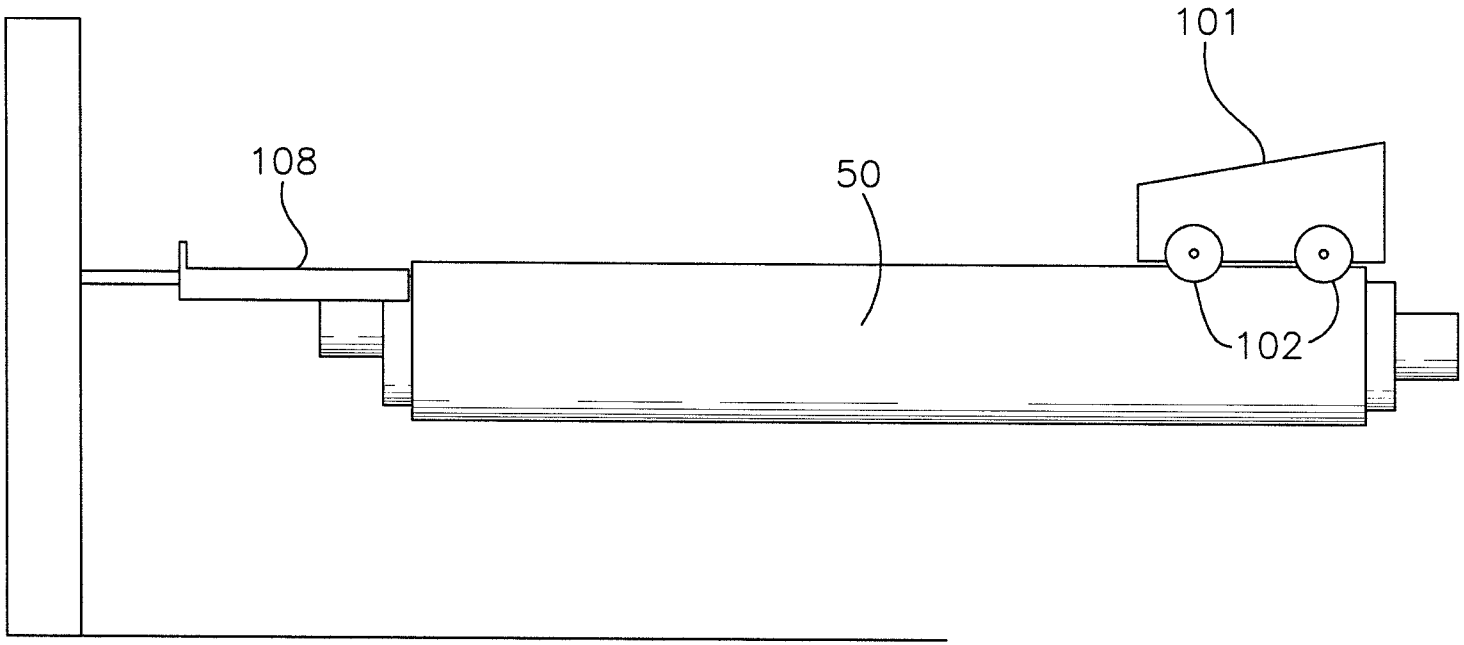
FIG. 7 illustrates an embodiment of a transfer tape dispenser unit that can be set on a web spool for applying the transfer tape directly to the web spool's surface as the tape exits the dispenser.

Still another embodiment for the dispenser apparatus 100, shown in FIG. 7, is a wheeled dispenser 101 that can be set onto the web spool 50 for applying the transfer tape 30 directly to the web spool 50 as the tape 30 exits the dispenser 101. This portable, direct-application embodiment is similar to the previously described dispenser apparatuses 100 except that it has wheels or rollers 102 to support and guide the dispenser 101 along the web spool 50 and that it has a means to remove the release liner 13 from the mounting side of the tape 30 to expose and apply the mounting-side PSA 14 to the web spool 50. The wheeled dispenser 101 is retracted to reside on a docking station 108 when not in use.

Figure 8:
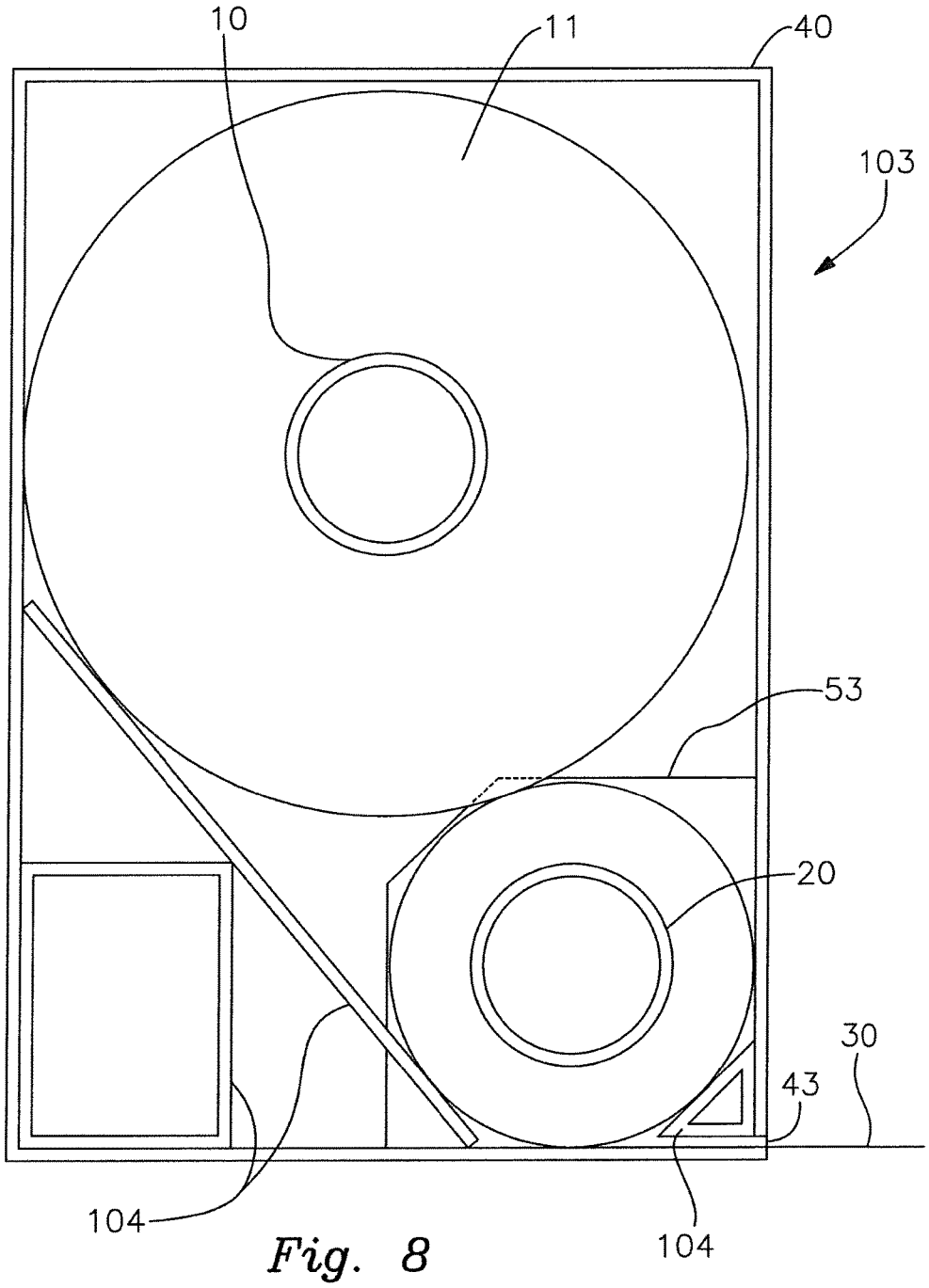
FIG. 8 illustrates another embodiment of the transfer tape dispenser enclosed within a housing.
Figure 9:
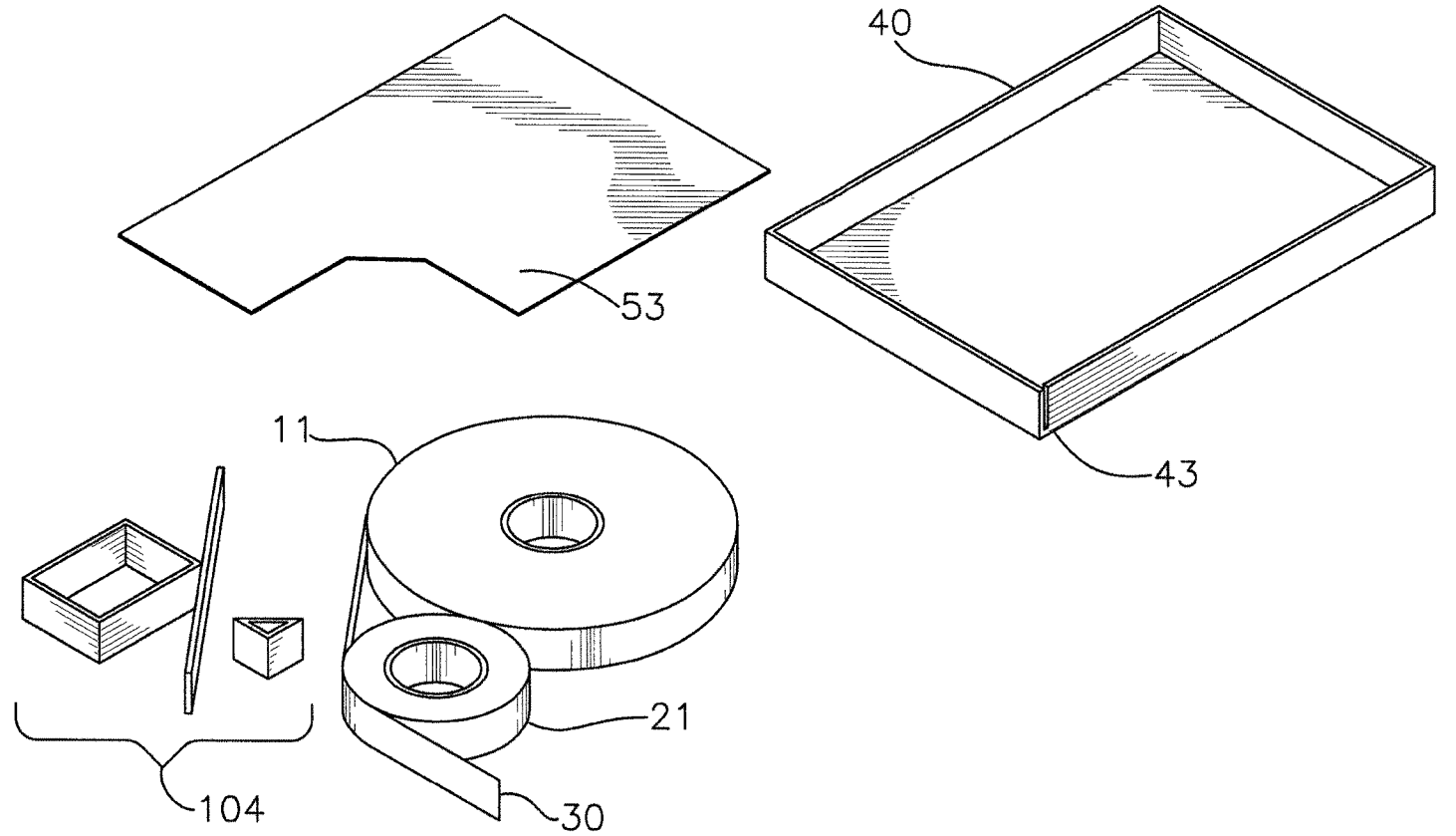
FIG. 9 is an exploded view of the components of FIG. 8.
Figure 10:
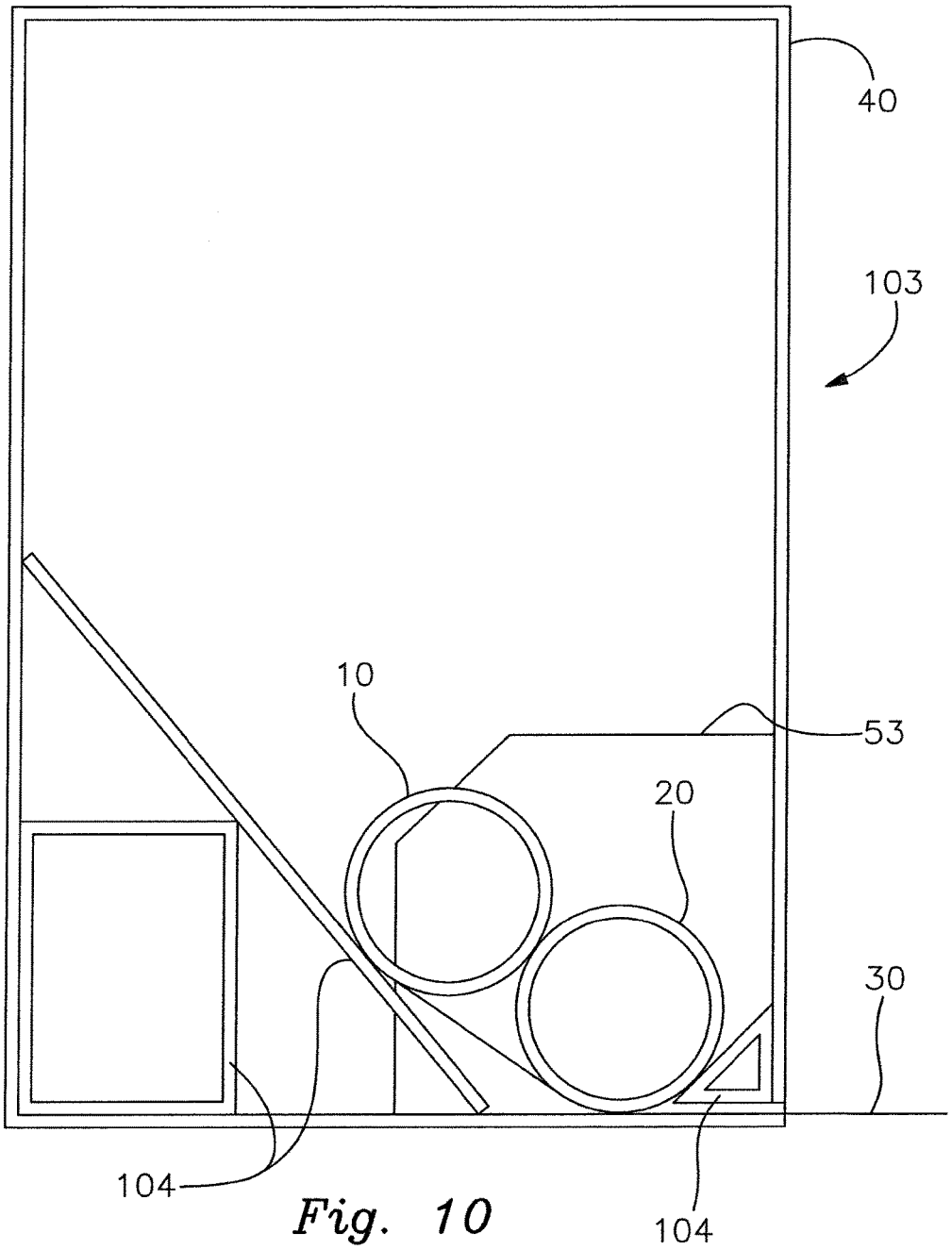
FIG. 10 illustrates the dispenser of FIG. 8 with empty spools.
Figure 11:
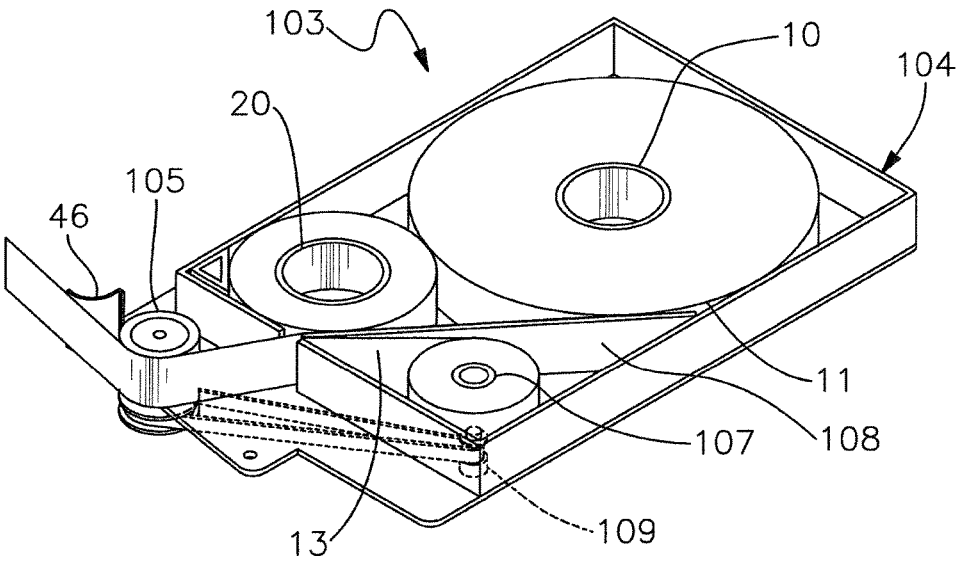
FIG. 11 is an exposed view of another embodiment of the dispenser, the dispenser comprising a take-up spool to accumulate the release liner when it is removed.
Figure 12:
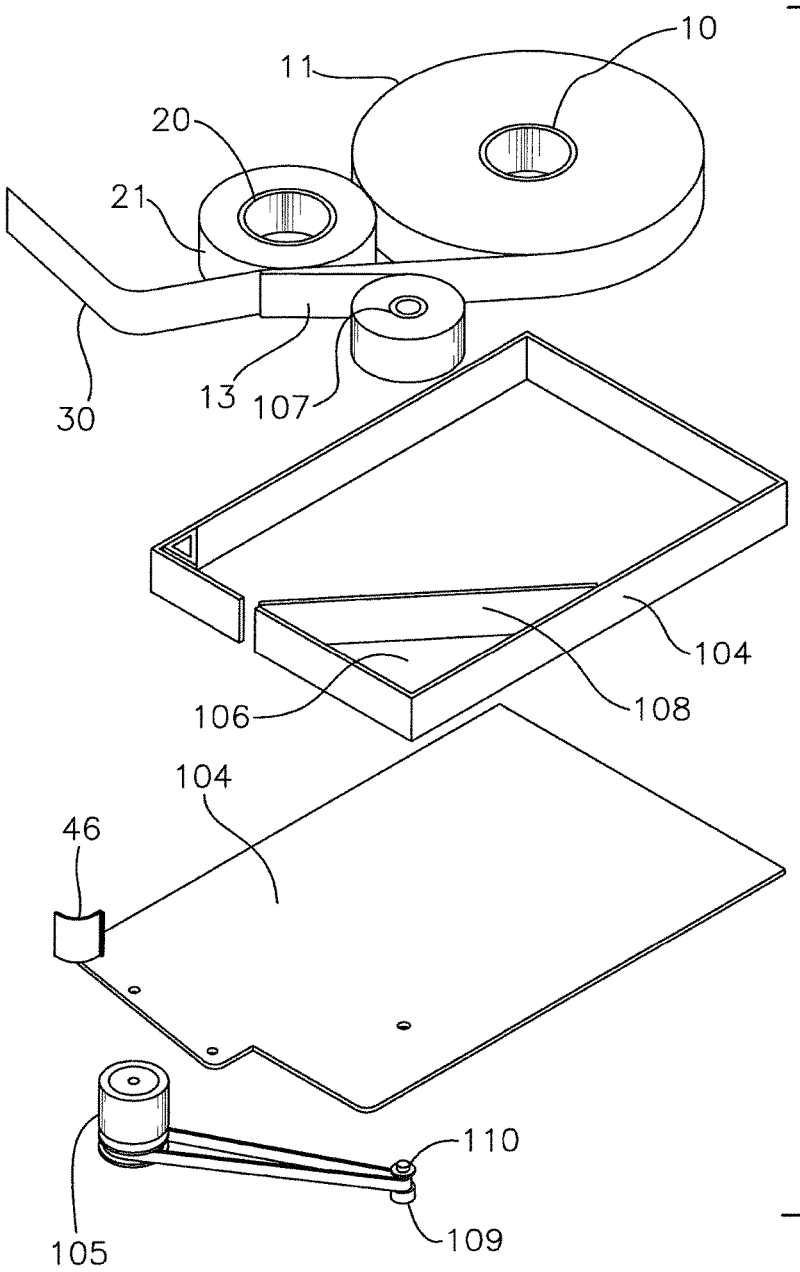
FIG. 12 is an exploded view of the dispenser embodiment of FIG. 11.
Figure 13:
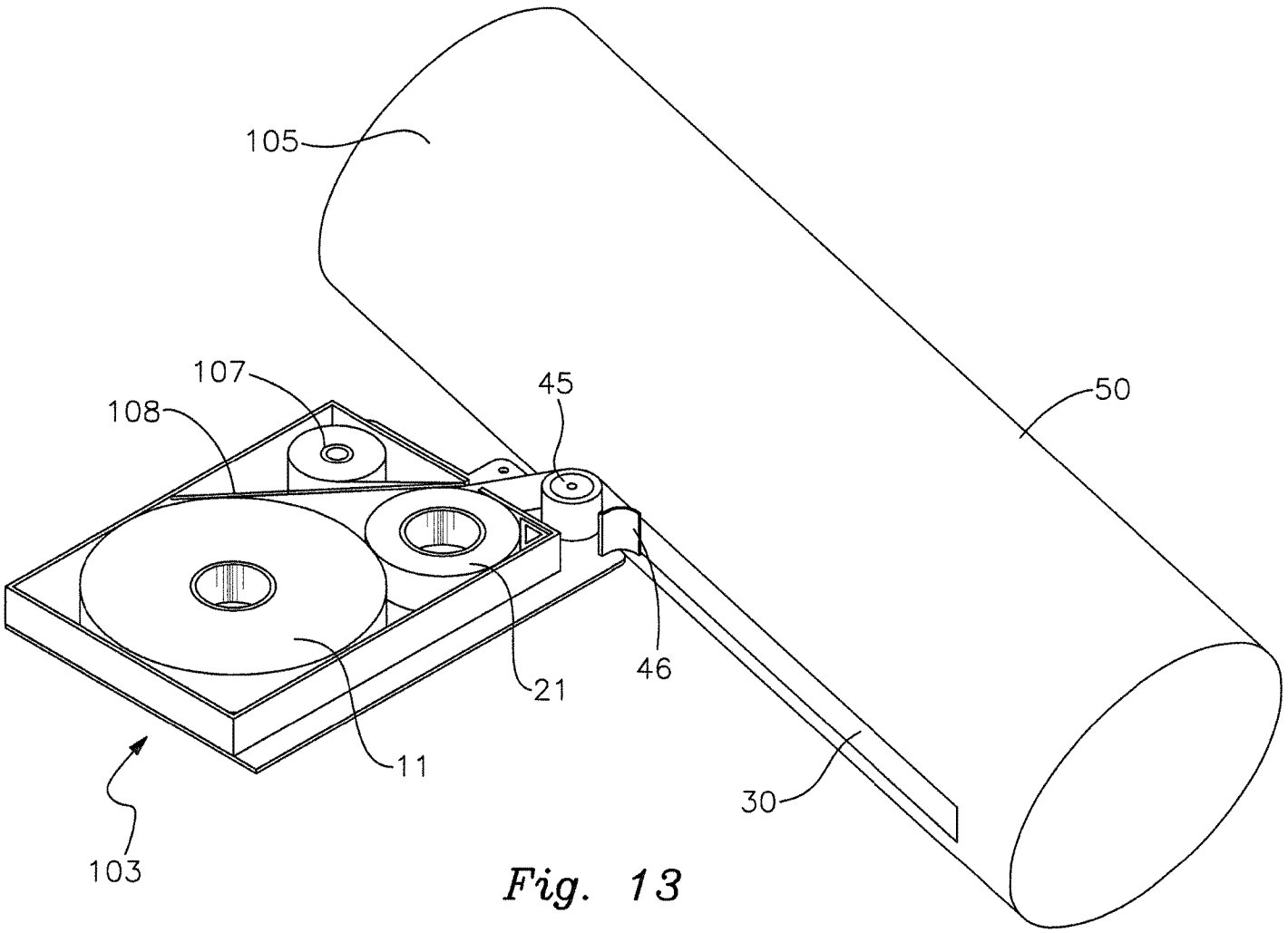
FIG. 13 is an exposed view of the dispenser of FIG. 11 as the transfer tape is applied to an empty turn-up spool.
Figure 14:
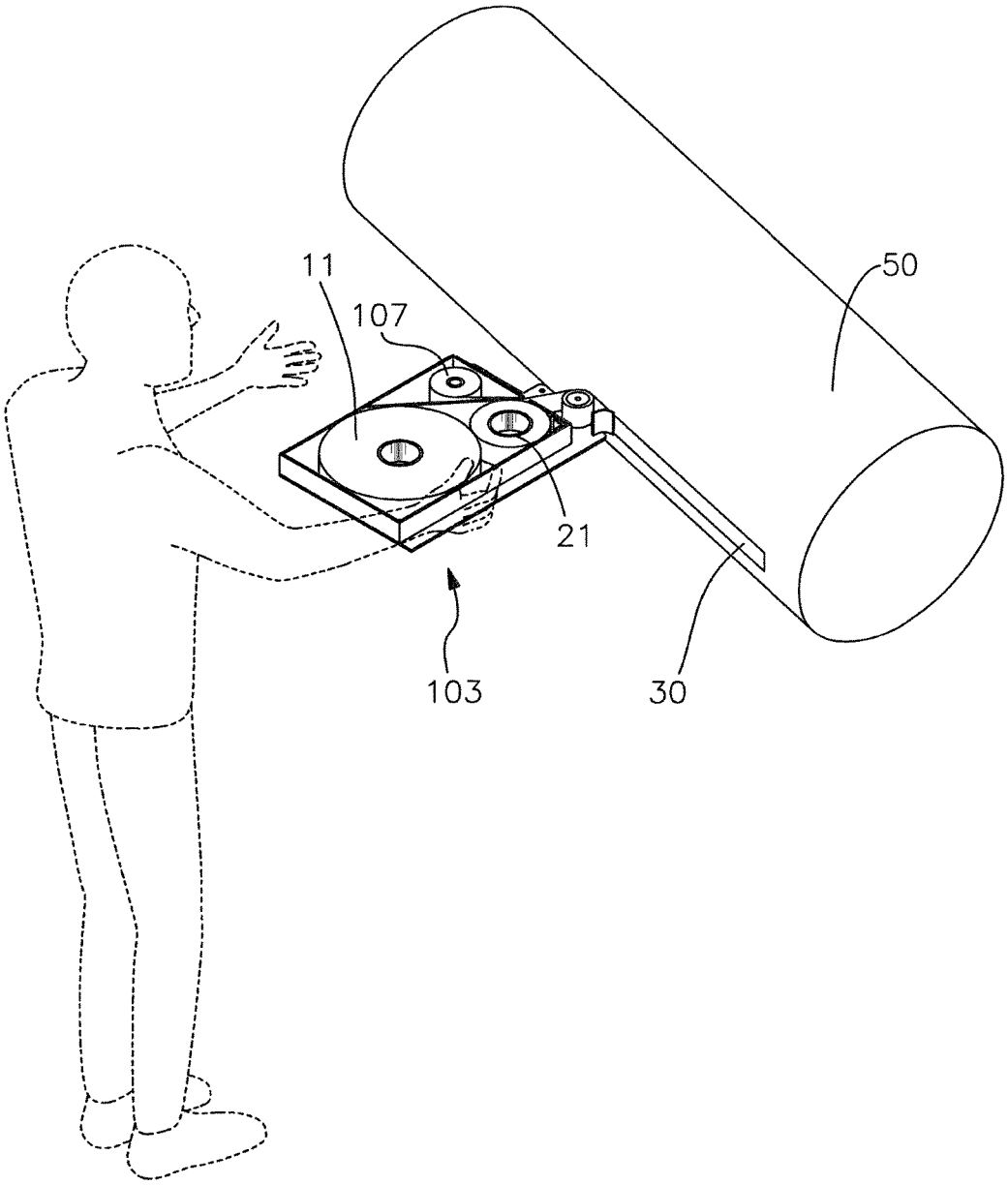
FIG. 14 is an illustration of the dispenser of FIG. 11 as used by a person to apply the transfer tape to an empty spool.

Still another embodiment for the dispenser apparatus 100 is shown in FIGS. 8-10. In this embodiment, the dispenser enclosure or housing 40 comprises a package (in this case a cardboard box) configured to align and house the loaded transfer tape spools 10/20.

In this example, the first tape component 11 consists of a substrate 12 with mounting-side PSA 14 on one side and web-side PSA 15 on the other side, and a double-sided release liner 13 laminated to the mounting-side PSA 14. The release liner 13 is temporary since it is only used for the winding of the first tape component 11 onto the first transfer tape spool 10 to keep it from sticking to itself and to protect its mounting-side PSA 14 until such time as it is removed for affixing the finished transfer tape 30 to the empty web spool 50 in preparation for the turn-up. The first tape component 11 is wound with the mounting-side PSA 14 and the release liner 13 to the outside of the roll. Since the first tape component 11 is considerably thicker than the second tape component 21, for the two tape components 11/21 having the same length, the roll of the first tape component 11 on the first transfer tape spool 10 will have a greater diameter than the roll of second tape component 21 on the second transfer tape spool 20.

To load the dispenser apparatus 100, the two tape component spools 10/20 are positioned as shown in the dispenser enclosure 40, with structure support guides 104 maintaining the spools 10/20 in proper relation. The spools 10/20 are not fixed to a location, but are free to shift within the housing 40 as the tape components 11/21 are removed from the spools 10/20. A short lead portion of each tape component 11/21 is pulled off of the spools 10/20, brought into proper edge alignment and laminated together upon installing the rolls in the dispenser. In this embodiment, the first tape component 11 is narrower than the zone-coated second tape component 21. This is so the cover flap member 22 overhangs or extends beyond the leading edge 25B of the substrate 12 to better accomplish the opening of the cover flap member 22. In order to maintain proper alignment of these two tape components 11/21, which possess different widths, an alignment shim 53 may be inserted into the enclosure 40 to fill the gap between the narrower first tape component 11 and the sides of the enclosure 40, the sides of the enclosure being so spaced as to accommodate and limit lateral travel of the wider second tape component 21. Instead of an alignment shim 53, the two tape components 11/21 may be wound on transfer tape spools 10/20 having the same axial length, with both tape components 11/21 wound flush with the same ends of the spools 10/20. In this arrangement the two opposing sides of the enclosure 40 can be so spaced as to control the alignment of both tape components 11/21 without the need for a separate shim or spacer 53. The two component rolls will then be dispensed with the trailing edge 26A (hinge side) of the second tape component 21 adjacent to the trailing edge 26B of the first tape component 21, and with the leading edge 25A of the second tape component 21 extended beyond the leading edge 25B of the first tape component 11, thus achieving the desirable extended flap configuration of the transfer tape 30.

Inside the enclosure 40 the tape components 11/21 will be drawn into contact with each other as the transfer tape spools 10/20 turn in opposing directions as the laminated tape 30 is pulled from the dispenser apparatus 100. These conditions naturally provide some drag which is beneficial to the laminating process as it helps to keep the tape components 11/21 taut and properly aligned, with suitable contact pressure for the web-side PSA 15 to adhere to the joining strip 24 of the cover flap member 22. The dispenser apparatus 100 maintains these tape relationships from full to empty spools 10/20. The spools are provided with the same length of each tape component 11/21 and therefore empty at the same time. The initial alignment is maintained as the tape 30 is pulled from the dispenser apparatus 100 by virtue of the side walls of the dispenser enclosure 40 providing the necessary guidance to the rolls of tape components 11/21 and their extended, unrolled portions.

The lamination is maintained by the strong adhesion of the web-side PSA 15 to the uncoated longitudinal strip portion 24 of the cover flap member 22. The web-side PSA 15 is an aggressive adhesive and securely adheres to the joining strip 24 of the cover flap member 22. The freshness of the lamination also ensures a relatively weak adhesion of the web-side PSA 15 to the release coated portion 23 of the cover flap member 22, ensuring the easy opening property required. This fresh, smooth lamination and the subsequent easy release of the cover flap member 22 is a set of properties that are extremely difficult to achieve in a pre-manufactured roll of finished tape 30 due to the problems of buckling and excessive adhesion brought on by time and roll pressure.

Preferably, one end or side of the dispenser enclosure 40 is removable to allow for insertion and removal of the various components, preferably in a cartridge format. A small opening 43 in the side of the housing 40 allows the finished laminated turn-up tape 30 to exit the dispenser apparatus 100. The enclosure 40, spools 10/20 and alignment shim 53, if present, will be sized to provide proper alignment of the tape components 11/21 and to provide adequate frictional drag to maintain suitable tension on the tape components 11/21. This will allow the dispenser apparatus 100 to be used in any orientation.

This dispenser enclosure cartridge 103 will be loaded initially at the manufacturer and a short length of the finished tape 30 brought out and then secured to an adjacent side of the cartridge 103. To preserve the shelf-life of the product the whole cartridge 103 should be sealed with a disposable wrapper material such as cellophane or like material. At the point of use this wrapper is removed and discarded and the short length of tape 30 is pulled away from the side of the cartridge 103. The operator then pulls the freshly laminated tape 30 from the dispenser apparatus 100 to the required length and cuts or tears the tape 30 to disconnect this segment from the dispenser apparatus 100.

Since the finished laminated turn-up tape 30 has a temporary release liner 13 on the mounting side and a cover flap member 22 on the web-grabbing side, the dispensed transfer tape 30is easily handled without contamination. If desired, several lengths can be dispensed in preparation for use. To apply the finished tape 30 to an empty web spool 50, the operator aligns the tape 30 in the axial direction on the web spool 50, usually by resting the tape 30 on top of the web spool 50 axle surface in its proper position. A starter portion of the release liner 13 is then removed from one end of the tape 30 and the mounting-side PSA 14 pressed down to adhere to the empty web spool 50 with simple hand pressure. The operator will then peel the remaining release liner 13 from under the turn-up tape 30 as he/she presses the exposed mounting-side PSA 14 to the empty web spool 50. The turn-up tape 30 is now properly installed and ready for the turn-up to commence. Preferably the entire dispenser cartridge 103 is made of materials that are re-pulpable, such that the spent cartridge can be recycled into the paper process.

Another embodiment, illustrated in FIGS. 11-14, consists of a disposable cartridge 103 containing a take-up spool 107 to wind and accumulate the release liner 13. The frame 104, which is intended for long life and use with many disposable cartridges 103, is configured to utilize the movement of the cartridge 103 along the spool 50 to automatically turn the take-up spool 107 inside the cartridge 103 to remove the release liner 13 from the first tape component 11 and store it within a reservoir 106 within the cartridge 103. In this embodiment the release liner 13 is retained within the disposable cartridge 103, relieving the operator of the task of its handling. The frame 104 utilizes a roller 105 to apply the laminated transfer tape 30 to the empty spool 50. This roller 105 turns in direct proportion to the tape application. A winding mechanism 109 comprising for example a belt and pulleys, a chain and sprockets, sets of gears, or any of a combination of these items, is utilized to transfer the turning of the application roller 107 into a turning action of the take-up spool 107 within the cartridge 103. The take-up spool 107, though contained within the disposable cartridge 103, is arranged to be free to turn and wind up the release liner 13 as it is removed from the first tape component 11. The take-up spool 107 may have at least one end of its shaft exposed through the cartridge 103 with features to allow it to be easily engaged by the winding mechanism 109. A barrier wall 108 is disposed inside the cartridge 103 and positioned to separate the transfer tape spools 10/20 from the release liner take-up spool 107. The cartridge 103 and frame 104 are so configured as to engage the winding mechanism 109 when the cartridge 103 is properly loaded with respect to the frame 104. Since the application roller 105 turns at a fixed ratio to the length of transfer tape 30 delivered, but the roll on the take-up spool 107 will be increasing in diameter as it winds up the release liner 13, there is a clutch mechanism 110 built into the drive train for this winding mechanism 109. This clutch mechanism 110 can be as simple as a smooth belt that slips when the winding and driving torques are appropriately different and reengages as necessary. This clutch mechanism 110 can also consist of friction surfaces on the face or diameters of the drivetrain components such as a pulley.

This embodiment thus consists of a cartridge 103 having a first transfer tape spool 10 with the first tape component 11 preloaded thereon, a second transfer tape spool 20 with the second tape component 21 preloaded thereon, a pre-threaded take-up spool 107 for removing and storing the release liner 13 of the first tape component 11, and a frame 104 configured to easily dispense and apply the laminated transfer tape 30 while simultaneously winding up the release liner 13.

When the cartridge 103 is exhausted, i.e., when all the tape components 11/21 are appropriately used up, the cartridge 103 will contain the empty transfer tape spools 10/20 and a full take-up spool 107 of the removed release liner 13. The spent cartridge 103 is then removed from the frame 104 and a new, full cartridge 103 is inserted.

It is further conceived that the dispenser apparatus 100 can be configured to use constituents that are liquid to create the PSA's, for example. The PSA can also be incorporated in this invention as a single or multi-part liquid adhesive that is mixed and applied onto the appropriate surfaces of the substrate 12. This has the further advantage of even broader properties that are not readily achievable in a pre-manufactured tape roll. These properties include but are not limited to tackiness, adhesion strength, shelf life, thickness, color, scent, curing conditions, repulpability, etc.

It is further conceived that this dispenser enclosure can be utilized for applications other than for making an optimal transfer tape for paper web transfer or turn-up systems. There are many situations where a product cannot be suitably pre-manufactured and requires on-demand manufacturing. This situation is easily envisioned for situations where shelf life or pot-time is critical or short, or when the range of different products made from different combinations and quantities of relatively few constituents is very broad, or when contamination of the supply material(s) is a problem, or when the final product is in a form that is not easily premanufactured and stored.

The additional operations conceived to be performed within this dispenser enclosure also includes operations such as ultraviolet (UV) light curing (or partial curing), laser operations for cutting, marking and bonding, and the use of low or high pressure air to affect the condition of the product such as inflating a flap to form a bubble in its contact with a PSA coating, or to use compressed air to press materials together or to dry a wetted surface. Thermal affects are also conceived to be employed within this dispenser enclosure for selectively heating or cooling a component for achieving a desired property in the resulting product.

Medical applications of this invention are also conceived. UV light can be used to sterilize components prior to or even after their lamination within the dispenser enclosure. Prescribed dosages of medicines tailored to the situation at hand can be applied as needed. Even encapsulation of such tailored dosages is within the capability of this dispenser.

It is understood that equivalents and substitutions for elements or steps described above may be obvious to those of skill in the art, and therefore the true scope and definition of the invention is to be as set forth in the following claims.

We claim:

1. A transfer tape cartridge dispenser comprising:

a housing retaining a first transfer tape spool, a second transfer tape spool and a press apparatus;

said first transfer tape spool containing a first tape component, said first tape component comprising a transfer tape substrate having a width, a mounting-side adhesive disposed on one side of said transfer tape substrate, a web-side adhesive disposed on the opposite side of said transfer tape substrate, and a release liner disposed on said mounting-side adhesive;

said second transfer tape spool containing a second tape component, said second tape component comprising a cover flap member having a width, a longitudinal edge and a release coating disposed on said cover flap member, wherein said release coating is zone-coated onto said cover flap member such that a longitudinally-extending uncoated joining strip is defined adjacent said longitudinal edge of said cover flap member;

whereby said press apparatus is adapted to press together said first tape component and said second tape component, such that upon passing said first tape component and said second tape component through said press apparatus said web-side adhesive of said first tape component is joined to said uncoated joining strip of said second tape component to form a transfer tape, said transfer tape being adapted to sever and secure a paper web from a first web spool onto an empty web spool in a web turn-up operation in a manner whereby with said release liner removed from said mounting-side adhesive, said mounting-side adhesive being adapted to adhere said transfer tape to the empty web spool, and further whereby said cover flap is adapted to open to expose said web-side adhesive upon rotation of the empty web spool, said web-side adhesive being adapted to adhere to the paper web.

2. The dispenser of claim 1, wherein said mounting-side adhesive and said web-side adhesive are pressure sensitive adhesives.

3. The dispenser of claim 1, wherein said housing further comprises a slot, and wherein said transfer tape passes through said slot.

4. The dispenser of claim 1, further comprising one or more guide rollers adapted to guide said first tape component and said second tape component.

5. The dispenser of claim 1, further comprising a cutter apparatus adapted to sever said transfer tape.

6. The dispenser of claim 1, further comprising an embossing mechanism adapted to emboss said transfer tape.

7. The dispenser of claim 1, further comprising a wiper member adapted to apply pressure to said transfer tape during the application of said transfer tape to the empty paper web.

8. The dispenser of claim 1, wherein said press apparatus comprises a pair of rollers.

9. The dispenser of claim 1, wherein said cover flap member width is greater than said transfer tape substrate width, and wherein said uncoated joining strip is folded inwardly such that said web-side adhesive of said first tape component is joined to said folded uncoated joining strip when said first tape component and said second tape component are passed through said press apparatus.

10. The dispenser of claim 9, said housing further comprising a folding mechanism adapted to fold said cover flap member to create said folded uncoated joining strip.

11. The dispenser of claim 9, further comprising perforating mechanism adapted to longitudinally perforate said cover flap member to define said folded uncoated joining strip.

12. The dispenser of claim 1, said housing further comprising a take-up spool adapted to accumulate said release liner removed from said transfer tape substrate.

13. A method of producing a transfer tape, said transfer tape being adapted to sever and secure a paper web from a first web spool onto an empty web spool in a web turn-up operation, said method comprising the steps of:

providing a first tape component wound onto a first transfer tape spool, said first tape component comprising a transfer tape substrate having a width, a mounting-side adhesive disposed on one side of said transfer tape substrate, a web-side adhesive disposed on the opposite side of said transfer tape substrate, and a release liner disposed on said mounting-side adhesive;

providing a second tape component wound onto a second transfer tape spool, said second tape component comprising a cover flap member having a width, a longitudinal edge and a release coating disposed on said cover flap member, wherein said release coating is zone-coated onto said cover flap member such that a longitudinally-extending uncoated joining strip is defined adjacent said longitudinal edge of said cover flap member;

joining said first tape component to said second tape component to form a transfer tape by pressing together said web-side adhesive of said first tape component to said uncoated joining strip of said second tape component; and severing said transfer tape to separate the transfer tape from the first and second taper components.

14. The method of claim 13, further comprising the step of removing said release liner from said mounting-side adhesive.

15. The method of claim 14, further comprising the step of adhering said mounting-side adhesive of said transfer tape to an empty web spool with said cover flap oriented to open to expose said web-side adhesive upon rotation of the empty web spool.

16. The method of claim 15, further comprising the step of adhering said web-side adhesive to a paper web.

17. The method of claim 16, wherein said step of joining said first tape component to said second tape component to form said transfer tape and said step of severing said transfer tape is performed immediately prior to said step of removing said release liner from said mounting-side adhesive and said step of adhering said mounting-side adhesive of said transfer tape to the empty web spool.

18. The method of claim 17, wherein said step of adhering said mounting-side adhesive of said transfer tape to the empty web spool is performed manually.

19. The method of claim 13, further comprising the step of enclosing said first tape component and said second tape component to preclude particulate contamination of said mounting-side adhesive and said web-side adhesive.

20. A paper web turn-up method comprising the steps of:

producing a transfer tape adapted to sever and secure a paper web from a first web spool onto an empty web spool in a web turn-up operation, said step of producing said transfer tape comprising:

providing a first tape component wound onto a first transfer tape spool, said first tape component comprising a transfer tape substrate having a width, a mounting-side adhesive disposed on one side of said transfer tape substrate, a web-side adhesive disposed on the opposite side of said transfer tape substrate, and a release liner disposed on said mounting-side adhesive;

providing a second tape component wound onto a second transfer tape spool, said second tape component comprising a cover flap member having a width, a longitudinal edge and a release coating disposed on said cover flap member, wherein said release coating is zone-coated onto said cover flap member such that a longitudinally-extending uncoated joining strip is defined adjacent said longitudinal edge of said cover flap member;

joining said first tape component to said second tape component to form a transfer tape by pressing together said web-side adhesive of said first tape component to said uncoated joining strip of said second tape component; and severing said transfer tape to separate the transfer tape from the first and second taper components;

removing said release liner from said mounting-side adhesive;

adhering said mounting-side adhesive of said transfer tape to the empty web spool with said cover flap oriented to open to expose said web-side adhesive upon rotation of the empty web spool; and adhering said web-side adhesive to the paper web by rotating the empty web spool to open said cover flap and bringing said web-side adhesive into contact with the paper web.

21. The method of claim 20, wherein said step of joining said first tape component to said second tape component to form said transfer tape and said step of severing said transfer tape is performed immediately prior to said step of removing said release liner from said mounting-side adhesive and said step of adhering said mounting-side adhesive of said transfer tape to the empty web spool.

22. The method of claim 21, wherein said step of adhering said mounting-side adhesive of said transfer tape to the empty web spool is performed manually.

23. The method of claim 20, further comprising the step of enclosing said first tape component and said second tape component to preclude particulate contamination of said mounting-side adhesive and said web-side adhesive.

24. The method of claim 20, wherein said step of adhering said mounting-side adhesive of said transfer tape to the empty web spool is performed manually.

* * * * *